US006779605B2

(12) United States Patent
Jackson

(10) Patent No.: US 6,779,605 B2
(45) Date of Patent: Aug. 24, 2004

(54) DOWNHOLE TOOL DEPLOYMENT SAFETY SYSTEM AND METHODS

(75) Inventor: Cameron Jackson, Fort Worth, TX (US)

(73) Assignee: Owen Oil Tools LP, Houston, TX (US)

( * ) Notice: Subject to any disclaimer, the term of this patent is extended or adjusted under 35 U.S.C. 154(b) by 0 days.

(21) Appl. No.: 10/147,743

(22) Filed: May 16, 2002

(65) Prior Publication Data

US 2003/0213595 A1 Nov. 20, 2003

(51) Int. Cl.[7] ..... E21B 43/1185; E21B 29/00

(52) U.S. Cl. ..... 166/297; 166/381; 166/55.1; 166/65.1; 166/73; 175/4.56; 102/206; 102/275.11; 89/1.15

(58) Field of Search ..... 166/297, 373, 166/375, 381, 53, 55, 55.1, 65.1, 66, 72, 73, 113, 242.1, 243; 175/2, 4.53, 4.54, 4.56, 24, 26; 102/200, 206, 207, 216, 262, 275.11; 89/1.15, 28.1

(56) References Cited

U.S. PATENT DOCUMENTS 3,391,263 A * 7/1968 Young ..... 200/82 R
3,758,731 A * 9/1973 Vann et al. ..... 200/61.69
3,844,352 A * 10/1974 Garrett ..... 166/297
4,244,424 A * 1/1981 Talbot ..... 166/66
4,266,613 A * 5/1981 Boop ..... 166/299
4,306,628 A * 12/1981 Adams et al. ..... 175/4.56
4,523,650 A * 6/1985 Sehnert et al. ..... 175/4.56
4,967,048 A 10/1990 Langston
5,165,489 A * 11/1992 Langston ..... 175/4.54
5,191,936 A * 3/1993 Edwards et al. ..... 166/297
5,237,136 A * 8/1993 Langston ..... 200/81 R
5,346,014 A * 9/1994 Ross ..... 166/297
5,908,365 A * 6/1999 LaJaunie et al. ..... 175/4.56
5,954,135 A 9/1999 Williamson et al.
6,298,924 B1 * 10/2001 Vaynshteyn et al. ..... 175/4.54
2002/0195247 A1 * 12/2002 Ciglenec et al. ..... 166/250.11
2003/0131990 A1 * 7/2003 Tubel et al. ..... 166/250.01

* cited by examiner

*Primary Examiner*—David Bagnell
*Assistant Examiner*—Jennifer H Gray
(74) *Attorney, Agent, or Firm*—Madan, Mossman & Sriram, P.C.

(57) ABSTRACT

A safety system controls the activation of one or more downhole tools by providing selective transmission of an activation signal or an energy stream. In a preferred embodiment, transmission of the activation signal or the energy stream is allowed after the tool has passed below a known pre-determined depth. A preferred safety system includes a first device in fixed relationship with the downhole tool and a second device fixed at the stationary location. The first device permits, after reaching the pre-determined depth, either (a) an initiation signal to reach an initiation device associated with a downhole tool upon or (b) the energy stream to reach a downhole tool. The second device positively engages the first device to provide an indication that the specified depth has been reached.

23 Claims, 10 Drawing Sheets

DOWNHOLE TOOL DEPLOYMENT SAFETY SYSTEM AND METHODS

CROSS-REFERENCE TO RELATED APPLICATIONS

NONE.

BACKGROUND OF THE INVENTION

1. Field of the Invention

The present invention relates to devices and methods for preventing an unintended or premature activation of one or more downhole tools.

2. Description of the Related Art

One of the activities associated with the completion of an oil or gas well is the perforation of a well casing. During this procedure, perforations, such as passages or holes, are formed in the casing of the well to enable fluid communication between the well bore and the hydrocarbon producing formation that is intersected by the well. These perforations are usually made with a perforating gun loaded with shaped charges. The gun is lowered into the wellbore on electric wireline, slickline or coiled tubing, or other means until it is adjacent the hydrocarbon producing formation. Thereafter, a surface signal actuates a firing head associated with the perforating gun, which then detonates the shaped charges. Projectiles or jets formed by the explosion of the shaped charges penetrate the casing to thereby allow formation fluids to flow from the formation through the perforations and into the production string for flowing to the surface.

A number of arrangements can be used to actuate the firing head. For example, the firing head may be actuated by dropping a weight onto the firing head through tubing extending from the firing head to a wellhead or a platform at the earth's surface. The falling weight eventually strikes a firing pin in the firing head, thereby actuating a detonator explosively coupled to the perforating gun. Other tubing conveyed perforating systems employ a differential firing head that is actuated by creating a pressure differential across an actuating piston in the firing head. The pressure differential is created by applying increased pressure either through the tubing string or through the annulus surrounding the tubing string to move the actuating piston in the firing head. Typically, the firing head actuating piston will have hydrostatic pressure applied across the actuating piston as the tool is run into the well. When it is desired to operate the tool, the increase in pressure is sufficiently large to initiate detonation of the firing head and perforating gun. Often, perforating guns have been actuated electrically. The firing head and perforating gun are lowered into the well on a wireline. Electrical current is sent through the wireline to set off the firing head. The firing head in turn detonates the shaped changes in the perforating gun.

Regardless of the system used, it is desirable to ensure that the charges do not detonate prematurely. Premature detonation can be of particular concern when the perforating gun is on the surface; i.e., not within the confines of a well bore. For example, electrically actuated explosive device can be susceptible to detonation by stray electrical signals, radio signals picked up by the conductive wireline, static electricity or lightning strikes. Any electrical noise or discharges from any of these sources can cause the device to explode prematurely with the risk of damage to the production system and danger to operators on the oil production installation. Mishandling during transportation or during manual deployment may also inadvertently actuate mechanically actuated systems. Accordingly, a number of devices have been developed to prevent the premature detonation of charges carried by a perforating gun.

In an exemplary conventional safety system, a safety module associated with the perforating gun has a housing, a pressure sensitive switch and a temperature sensitive switch. The switches only allow an electrical command signal to be conveyed to the tool when the pressure and temperature both reach predetermined pressure and temperature values. In another exemplary safety system, applying fluid pressure to the exterior of a housing arms an electrical firing system. The firing system arms when the fluid pressure exceeds the well hydrostatic pressure. The firing system is controlled by a microprocessor that is preset to be responsive only to a selected value of fluid pressure surrounding the control housing. These systems depend, in part, on a reliable prediction of well bore conditions. If the temperature or pressure of the well bore at the desired depth does not match the pre-set values, then the gun will not arm. In these instances, the gun will have to tripped up and the safety module reset. It will be appreciated that this additional procedure lead to lost time and additional expenditures of effort and money.

Perforating guns are, however, only one example of downhole tools that require the use of safety mechanisms that control activation. Other tools, such as pipe cutters, use caustic acid to burn and sever a section of pipe. While the closed wellbore environment enables these downhole tools to operate safely, a common characteristic of these downhole tools is that unintended surface activation can cause injury to personnel and damage to nearby equipment.

The present invention addresses these and other drawbacks of the prior art.

SUMMARY OF THE INVENTION

The present invention provides devices and systems for controlling the activation of one or more downhole tools. In one aspect, the system prevents an unintended or premature activation of one or more downhole tools activated by an initiation device. A preferred system is configured to allow an initiation signal generated by a signal generator or source to reach the initiation device only after the downhole tool has reached a known pre-determined depth at a location that is substantially stationary relative to the earth's surface. The preferred safety system includes a first device associated with the downhole tool and a second device fixed at the stationary location. The first device is configured to permit an initiation signal transmitted by the generator to reach the initiation device upon reaching the stationary location ("signal pass-through"). The second device positively engages the first device to provide a positive indication that the specified depth has been reached. In another preferred embodiment, the system includes a bypass, a switch, and a trigger. The bypass is operably coupled to a signal conveyance medium connecting the generator to the initiation device. The bypass has a safe mode in during which it prevents signal pass-through and a fire ready mode during which it allows signal pass through. The switch is mechanically connected to the bypass and can move the bypass between the two modes. The trigger, however, is positioned at the relatively stationary location (e.g., in the wellhead or wellbore) and is configured to positively engage the switch. The trigger may be a rigid member, a biased member, or utilize hydraulic power. While at the surface, the bypass is by default set in the safe mode. During tool deployment, the switch engages the trigger during transit through a wellhead or well bore. This engagement may, for example, be facilitated by the cooperative action of alignment pins and channels. Engagement between the trigger and the switch causes the bypass to move from the safe mode to a fire ready mode. In a preferred embodiment, engagement between the trigger and the switch during tool extraction causes the bypass to move from a fire ready mode to a safe mode.

In a different aspect, a preferred safety system prevents an energy train generated by an initiation device from reaching the downhole tool until the downhole tool has reached a known depth in a well. The preferred safety mechanism includes a first device associated with the downhole tool and a second device fixed at a stationary location. The first device is configured to permit the energy stream to reach the downhole tool if the tool is below a specified depth below the earth's surface ("energy pass-through"). The second device positively engages the first device to provide an indication that the pre-defined or specified depth has been reached. In one preferred embodiment, the safety system includes a bypass, a switch, and a trigger. The bypass is operably coupled to a energy conveyance conduit connecting the initiation device to the downhole tool. The bypass has a safe mode in during which it prevents energy pass-through and a fire ready mode during which it allows energy pass through. The switch is mechanically connected to the bypass and can move the bypass between the two modes. The trigger, however, is positioned at the relatively stationary location (e.g., in the wellhead or wellbore) and is configured to positively engage the switch. The components operate in substantially the same way as previously described.

In related embodiments, trigger may include one or hydraulically actuated members such as finger or rams. The member can be configured to actuate the switch using a pre-defined movement (e.g., linear motion, rotation, and pivoting). Additionally, the preferred system can include a mode indicator operably connected to said trigger that provides an indication of whether the bypass can pass the initiation signal to the initiation device. Moreover, the trigger can include a biasing member for urging said trigger against said switch and/or maintaining the trigger in a predetermined position. Devices such as channels formed in a housing and/or pins can be used to guide the trigger to the switch. In one preferred embodiment, the system includes two triggers: a first trigger that causes the bypass to move from a safe mode to a fire ready mode, and a second trigger that causes the bypass to move from the fire ready mode to a safe mode. In another preferred embodiment, a housing enclosing the bypass includes a first section rotatably coupled to a second section. The bypass prevents signal pass-through when said first and second sections have a first relative angular alignment and permits signal pass-through when the first and second sections have a second relative angular alignment. Hydraulically actuated rams associated with the trigger are adapted to selectively move the first and second sections between the first and second relative angular alignments.

In another embodiment, the bypass is housed in a housing having an external sleeve member. The sleeve slides between a first position wherein the bypass permits signal pass-through and a second position wherein the bypass prevents signal pass-through. A trigger blocks sleeve movement in a pre-defined direction when extended. Force applied to the housing in a direction opposite to the pre-defined direction causes relative movement between the sleeve and the housing. This relative movement is used to shift the sleeve between the first and second positions.

Downhole tools that can be used with embodiments of the present invention include perforating guns, pipe cutters, and other tools that release a relatively substantial amount of energy when activated.

It should be understood that examples of the more important features of the invention have been summarized rather broadly in order that detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals and wherein.

DESCRIPTION OF THE PREFERRED EMBODIMENTS

Figure 1:
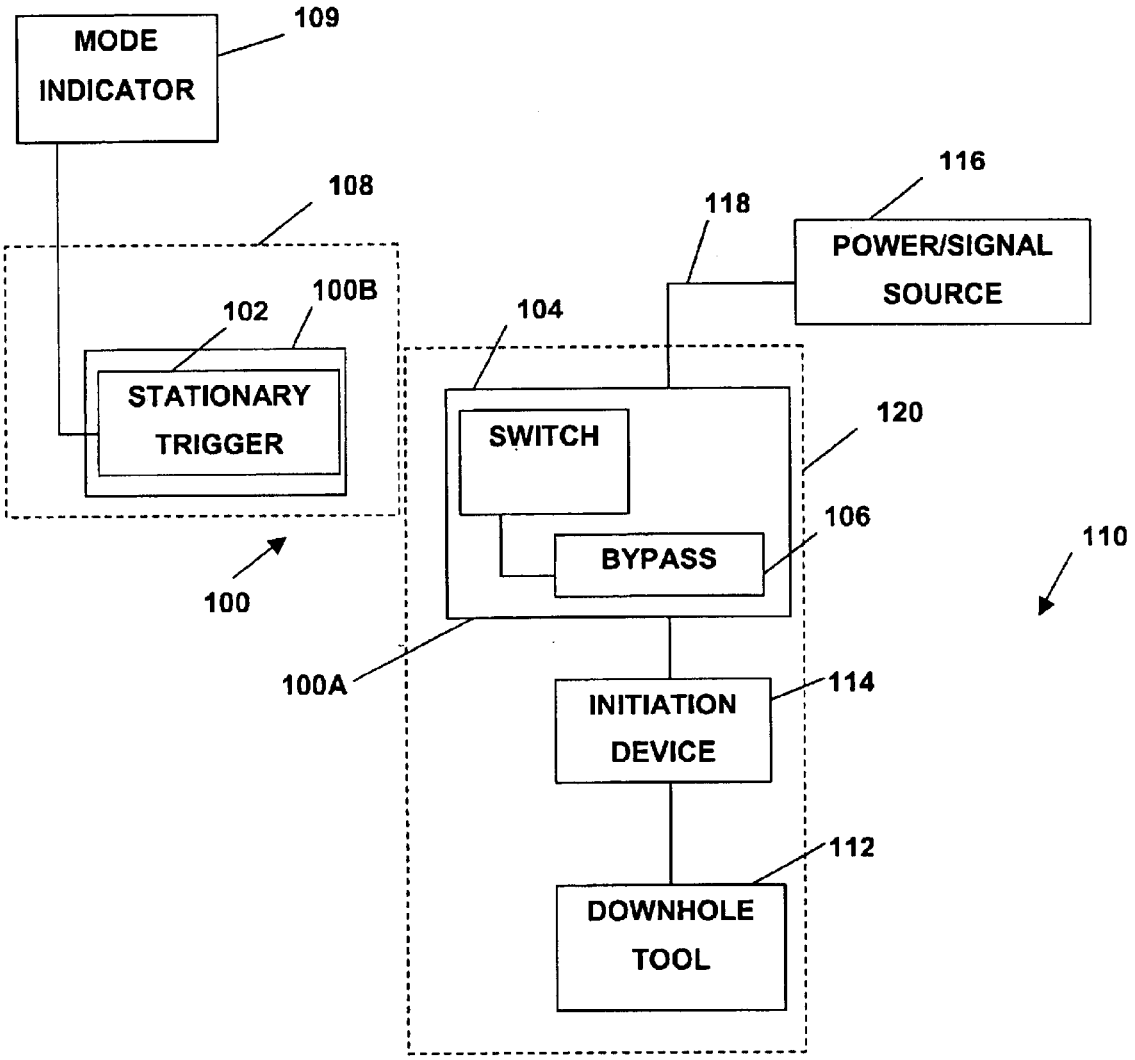
FIG. 1 schematically illustrates a preferred embodiment of the present invention that is adapted to selectively permit transmission of an initiation signal to an initiation device associated with a downhole tool.

The present invention relates to devices and methods for preventing an unintended or premature activation of one or more downhole tools. The present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to that illustrated and described herein.

Referring initially to FIG. 1, there is schematically illustrated a safety system 100 made in accordance with the present invention. The safety system 100 is deployed in conjunction with a conventional downhole tool system 110. The downhole tool system 110 includes a downhole tool 112, an initiation device 114, a power/signal source 116, and a signal/power conveyance medium 118. The downhole hole tool 112 and initiation device 114 may be housed in a single housing or in separate housings or subs (collectively identified with numeral 120). In this conventional arrangement, the signal/power source 116 transmits an initiation signal that may be electrical power and/or a command signal (e.g., an analog or digital data). This initiation signal is transmitted via the signal conveyance medium 118 to the initiation device 114. The initiation signal, however, can be generated by other sources (either natural or human-made), thus, for simplicity, it should be understood that the term "initiation signal" or "signal" includes any signals or power transmission, regardless of the source, than can actuate the initiation device 114. Upon receiving the initiation signal, the initiation device 114 activates the downhole tool 112 in a pre-determined manner.

The safety system 100 prevents the initiation signal from reaching the initiation device 114 until the downhole tool 112 until a predetermined condition has been met. In the preferred embodiment, this pre-determined condition is based on whether the downhole tool is below a specified depth below the earth's surface. The safety system 100 includes a first device 100A associated with the downhole tool 102 and a second device 100B fixed at a predetermined stationary location. The first device 100A has a fixed relationship with the downhole tool 102 and is configured to selectively permit an initiation signal transmitted by the source 116 to reach the initiation device 114 ("signal pass-through"). The second device 100B provides a positive indication to the first device 100A that the pre-determined condition has been satisfied. Preferably, the second device 100B is (a) positioned at a specified depth below the earth's surface; and (b) positively engages the first device 100A to provide a positive indication that the specified depth has been reached.

A preferred safety system 100 includes a stationary trigger 102, a switch 104, and a bypass 106. The bypass 106 allows the selective transmission of the initiation signal from the power/signal source 116 to the downhole tool 112. Moreover, the bypass 106, in certain arrangements, can also prevent stray signals from reaching the initiation device 114. The bypass 106 has a (a) safe mode wherein signal or power transmission is interrupted or blocked to the initiation device 114 and a (b) firing mode wherein the initiation device 114 can receive a signal or power. The bypass 106 is housed in a suitable location in the sub or housing 120. The switch 104 and trigger 102 cooperate to move the bypass 106 between the safe mode and the fire ready mode. The switch 104 is mechanically coupled to the bypass 106 and, like the bypass 106, is positioned in a sub or housing 120 that is either shared or connected, directly or indirectly, to the downhole tool 112. The trigger 102, however, is positioned on a stationary object 108. The stationary object 108 may be a wellhead, a portion of casing in the well bore, or other structure along which the downhole tool 112 must pass when conveyed into the well bore. Preferably, the trigger 102 is located at a pre-determined depth below the earth's surface. This pre-determined depth may, in certain applications, be defined by the depth at which activation of the downhole tool 112 will not cause substantial harm to surface equipment or personnel. In a preferred mode of operation, the motion of the downhole tool 112 causes mechanical interaction between the trigger 102 and the switch 104. Thus, the motion of the downhole tool 112 downhole causes the trigger 102 to engage the switch 104 in such a manner that the bypass 106 is put in a fire ready mode. Likewise, the motion of the downhole tool 112 uphole causes the trigger 102 to engage the switch 104 in such a manner that the bypass 106 is put in a safe mode. In a preferred arrangement, a mode indicator 109 in communication with the trigger 102 provides a positive indication (e.g., visual or auditory) of the present mode of the bypass 106.

Figure 2:
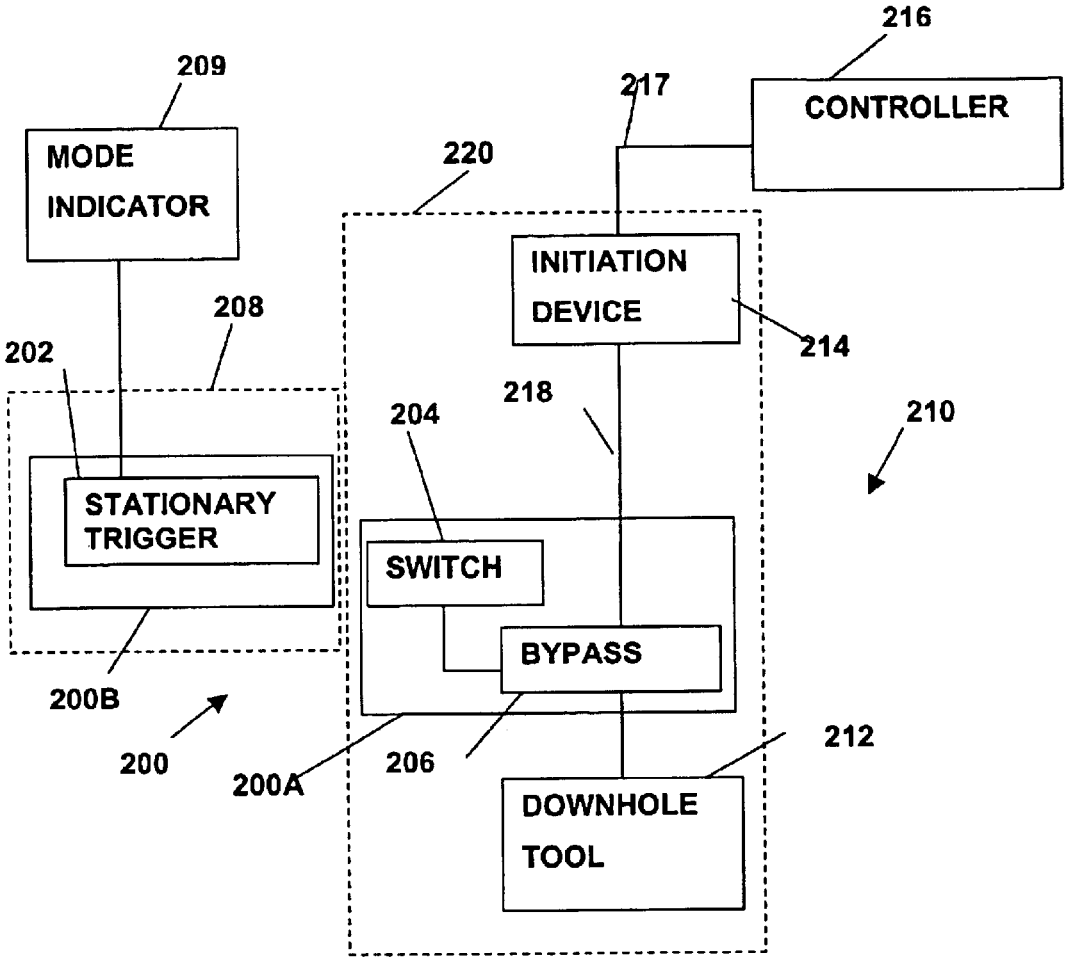
FIG. 2 schematically illustrates a preferred embodiment of the present invention that is adapted to selectively permit transmission of an energy stream to a downhole tool.

Referring to FIG. 2, there is schematically illustrated another safety system 200 made in accordance with the present invention. The safety system 200 is deployed in conjunction with a conventional downhole tool system 210. The downhole tool system 210 includes a downhole tool 212, an initiation device 214, a controller 216, and an energy conveyance conduit 218. The downhole hole tool 212 and initiation device 214 may be housed in a single housing or in separate housings or subs (collectively identified with numeral 220). In this conventional arrangement, the controller 216 transmits an initiation signal via a signal conveyance medium 217 to the initiation device 214. Upon receiving the initiation signal, the initiation device 214 generates an energy stream or train that flows via the energy conveyance conduit 218 to the downhole tool 212. This energy stream or train can include chemical energy, kinetic energy, thermal energy, or other known energy forms transported via a vapor or liquid stream, projectile, or other means.

The safety system 200 prevents the energy train from reaching the downhole tool 212 until a pre-determined condition has been met; e.g., whether the downhole tool 212 has reached a known depth in a well. The safety system 200 includes a first device 200A associated with the downhole tool 212 and a second device 200B fixed at a stationary location 208. The first device 200A has a fixed relationship with the downhole tool 212 and is configured to selectively permit an energy stream generated by the initiation device 214 to reach the downhole tool 212 ("energy pass-through" or "energy train pass-through"). This pre-determined condition is preferably a specified depth below the earth's surface. The second device 200B provides a positive indication to the first device 200A that the pre-determined condition has been satisfied. Preferably, the second device 200B is (a) positioned at a specified depth below the earth's surface; and (b) positively engages the first device 200A to provide a positive indication that the specified depth has been reached.

A preferred safety system 200 includes a stationary trigger 202, a switch 204, and a bypass 206. The bypass 206 allows the selective transmission of the energy train from the initiation device 214 to the downhole tool 212. The bypass 206 has a (a) safe mode wherein the energy flow is blocked and a (b) firing mode wherein the downhole tool 212 can receive the energy train. The other salient aspects of the bypass 206, the switch 204, and the trigger 202 are similar to those like-named features shown in FIG. 1. Thus, for brevity, the discussion of such features will not be repeated. Also, the stationary object 208 and mode indicator 209 operate in substantially the same manner as described in reference to FIG. 1.

As should be appreciated, the advantageous teachings of the present invention may be embodied in any number of arrangements. For brevity, only a few such embodiments will be discussed.

Figures 3A, 3B:
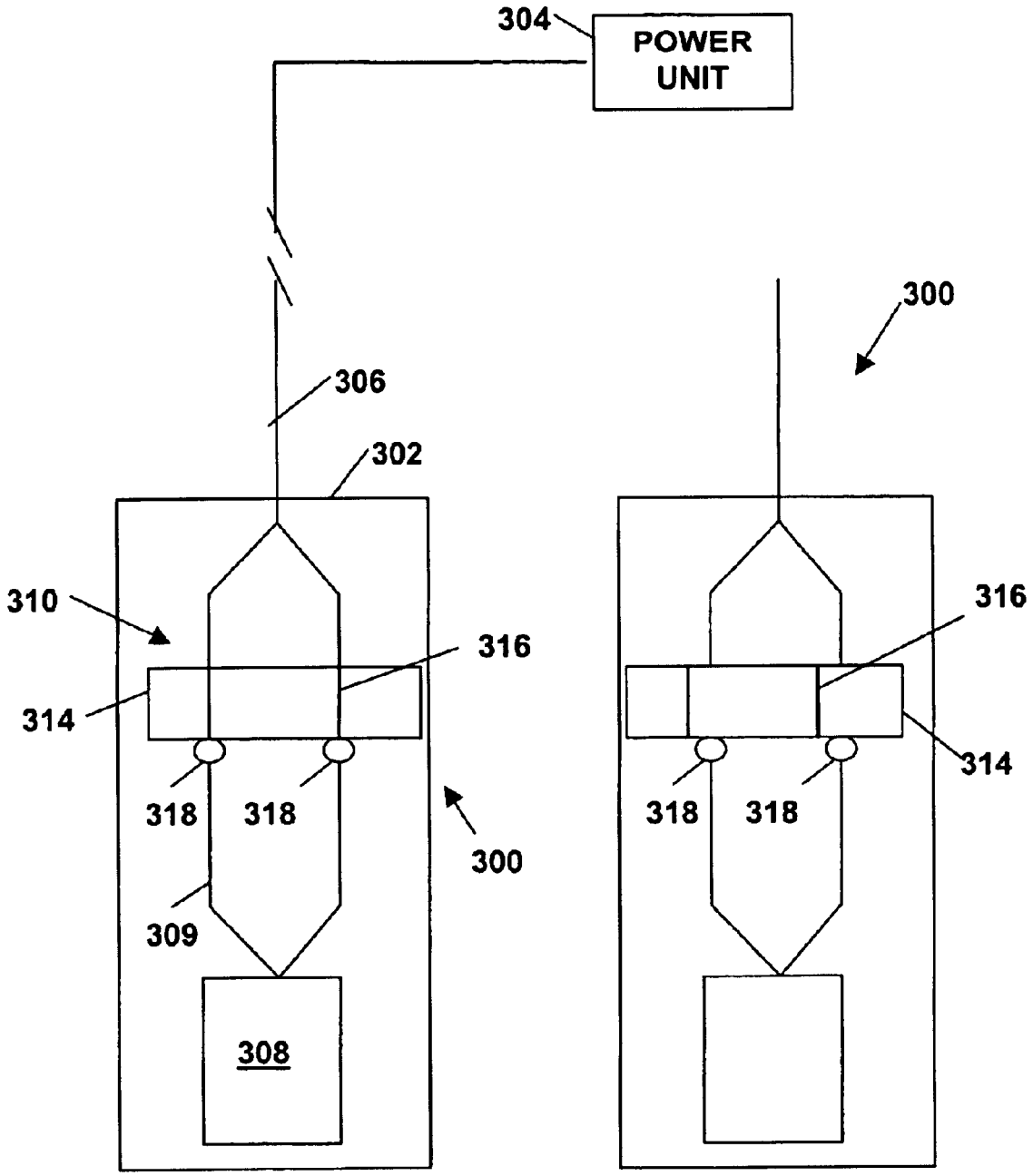
FIG. 3A schematically illustrates a fire ready mode of an exemplary bypass that is adapted to selectively permit transmission of an initiation signal to an initiation device.
FIG. 3B schematically illustrates a safe mode of an exemplary bypass that is adapted to selectively permit transmission of an initiation signal to an initiation device.

Referring now to FIG. 3A and 3B, there is schematically shown an exemplary bypass 300. Referring first to FIG. 3A, the bypass 300 is positioned in a housing 302 and is in electrical communication with a signal source/generator or power unit 304 via a signal conveyance medium 306 and with an initiation device 308 via lead wires 309. Preferably, the bypass 300 includes an electrical circuit 310 that is coupled to the conveyance medium 306. The electrical circuit 310 includes a shifting member 314, a bridge 316, and terminals 318. The bridge 316 is electrically connected to the signal conveyance medium 306 whereas the terminals 318 are connected to the lead wires 309. The shifting member 314 mechanically moves between a first (safe) position and a second (fire ready) position. In the first position, the shifting member 314 aligns the bridge 316 with the terminals 318 such that an electrical path is established between the power unit 304 and the initiation device 308. Referring now to FIG. 3B, in the second position, the shifting member 314 breaks the electrical path by disconnecting the bridge 316 from the terminals 318. The shifting member 314 can include, for example, a bar that moves axially, a disk that rotates, a sleeve that slides, or a lever that pivots. Other suitable mechanical arrangements will be apparent to one of ordinary skill in the art. Furthermore, the bypass 300 can also incorporate wiring (not shown) that introduces a short into the circuit 310 while in the first position to provide an additional measure of protection against unintended signal transmission to the initiation device 308.

Figure 4A:
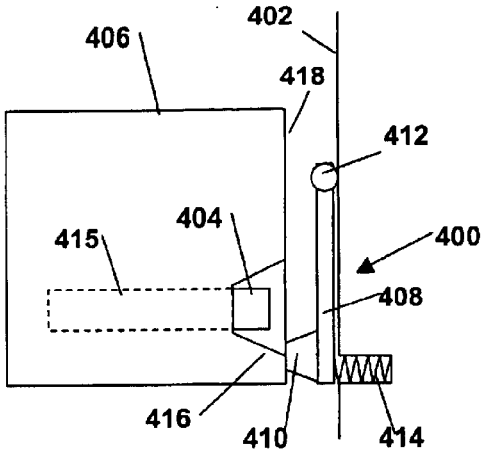
FIG. 4A schematically illustrates an exemplary embodiment of an safety system provided with a bypass, a switch, and a trigger.
Figure 4B:
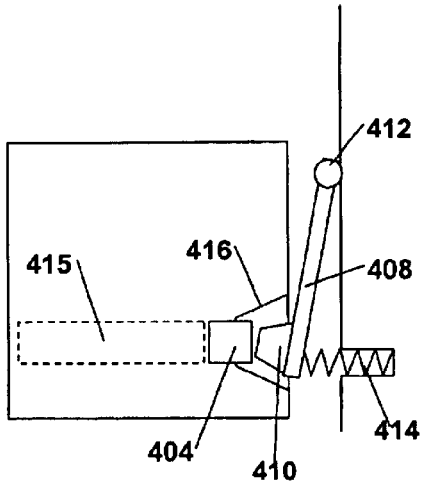
FIG. 4B schematically illustrates an exemplary trigger actuating a switch.

Referring now to FIGS. 4A and B, there is shown in schematic format an exemplary trigger and switch arrangements using primarily mechanical interaction. The trigger 400 is fixed on a stationary surface 402 and the switch 404 is disposed within a housing or sub 406. The trigger 400 includes an arm 408 with a protruding finger 410 at one end and a pivot joint 412 at the other end, and a biasing member 414. The switch 404 is connected to a bypass 415 using known linkages (not shown). The housing 406 is provided with an opening 416 that preferably generally conforms to the profile of the finger 410. A portion of the switch 404 protrudes out of the opening 416. The switch 404 can be adapted to slide axially, pivot, or rotate (e.g., in a ratchet-type fashion). During use, the trigger 400 assumes a retracted position (FIG. 4A) while the finger 410 rides along an outer surface 418 of the housing 406. Referring now to FIG. 4B, once the finger 410 reaches the opening 416, the biasing member 414 causes the arm 408 to pivot about the pivot joint 412 and thereby urge the finger 410 against the switch 404. The contact pressure provided by the finger 410, thus, causes the switch 404 to move in a pre-determined fashion. This movement causes the bypass 430 to move from a safe mode to a fire ready mode, or vice versa.

The FIGS. 4A and 4B embodiments are amenable to numerous modifications and variations. For example, referring now to FIG. 4C, there is shown a bypass 430, a dual action switch 432, an arming trigger 434, and a disarming trigger 436. The bypass 430 and the switch 432 are suitably disposed in a housing 437. The switch 432 is movable between a first and second position that correspond to a safe and fire ready modes of the bypass 430, respectively. The triggers 434,436 are fixed on a first relatively stationary location 438 and a second relatively location 439, respectively. Preferably, the triggers 434,436 are staggered such that disarming trigger 436 is uphole of the arming trigger 434. During deployment of a downhole tool (not shown), the bypass 430 is in a safe mode with the switch 432 in the first position. As the housing 437 moves in a downhole direction D, the switch 432 passes by the disarming trigger 436. Because the bypass 430 and switch 432 are already in a safe mode, the disarming trigger 436 does not perform any function. The switch 432, however, is actuated when the housing 437 passes by the arming trigger 434, thereby placing the bypass 430 in a fire ready mode with the switch 432 in the second position. During extraction of the downhole tool (not shown), the housing 437 moves in an uphole direction U and the switch 432 passes by the arming trigger 434. Because the bypass 430 and switch 432 are already in a fire ready mode, the arming trigger 434 does not perform any function. The switch 432, however, is actuated when the housing 437 passes by the disarming trigger 436, thereby placing the bypass 430 in a safe mode with the switch 432 in the corresponding first position.

Figure 4C:
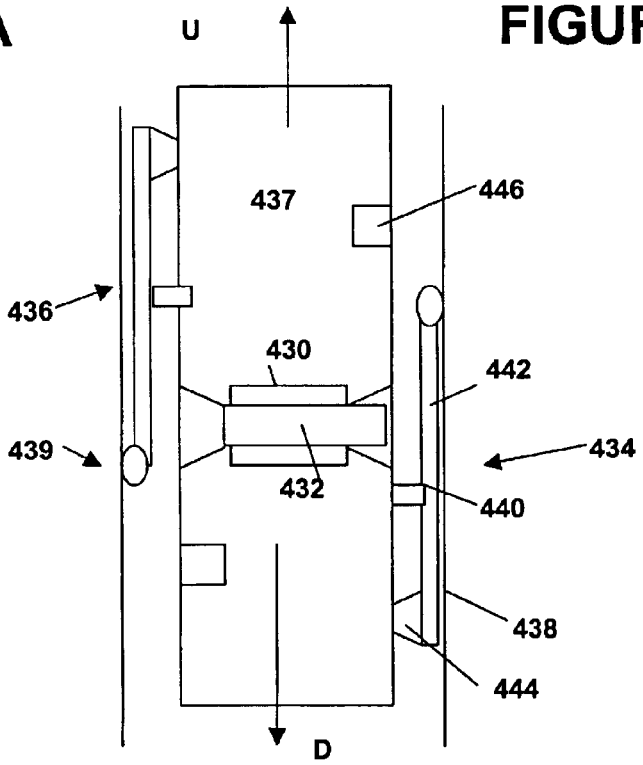
FIG. 4C schematically illustrates an exemplary embodiment of an safety system provided with a bypass, a dual action switch, a first trigger for causing the bypass to move into a fire ready mode, and a second trigger for causing the bypass to move into a safe mode.

Also shown in FIG. 4C is an alignment finger 440 formed on an arm 442 in spaced relation to a finger 444. An opening 446 in the housing 437 is provided to receive the alignment finger 440. The opening 446 has a fixed relationship to a switch 432 similar to that between the alignment finger 440 and the finger 444. Thus, the arm 442 will only pivot once the fingers 440 and 444 are aligned with the opening 446 and the switch 432, respectively. It will be appreciated that the FIG. 4C embodiment enables the automatic arming of a downhole tool during deployment and automatic disarming of the downhole tool during extraction. Thus, the downhole tool is advantageously in a safe mode while at or near the earth's surface.

Figure 4D:
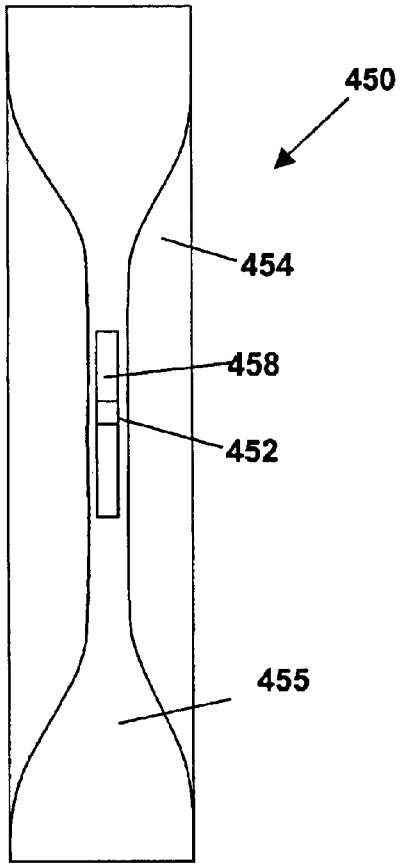
FIG. 4D schematically illustrates an exemplary embodiment of an safety system utilizing an alignment channel for guiding a trigger to a switch.
Figure 4E:
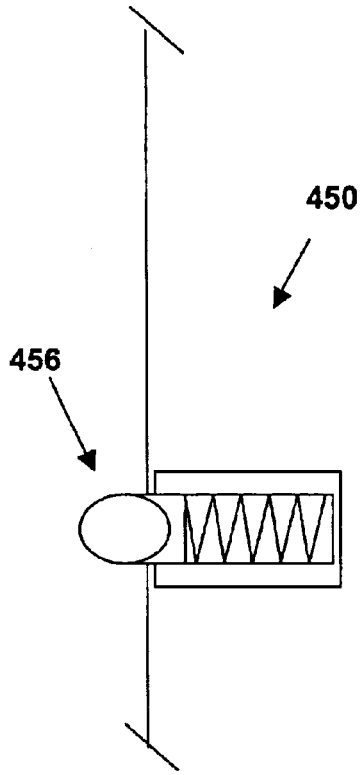
FIG. 4E schematically illustrates an exemplary biased trigger adapted to ride within the alignment channel shown in FIG. 4D.

Referring now to FIGS. 4D and 4E there is shown yet another embodiment of a safety apparatus 450 made in accordance with the teachings of the present invention. The safety apparatus 450 includes a bypass (not shown), a switch 452, a housing 454, and a trigger 456. Advantageously, the housing 454 includes an alignment channel 455 that longitudinally guides the trigger 456 into a slot 458 in which the switch 452 is disposed.

Figure 4F:
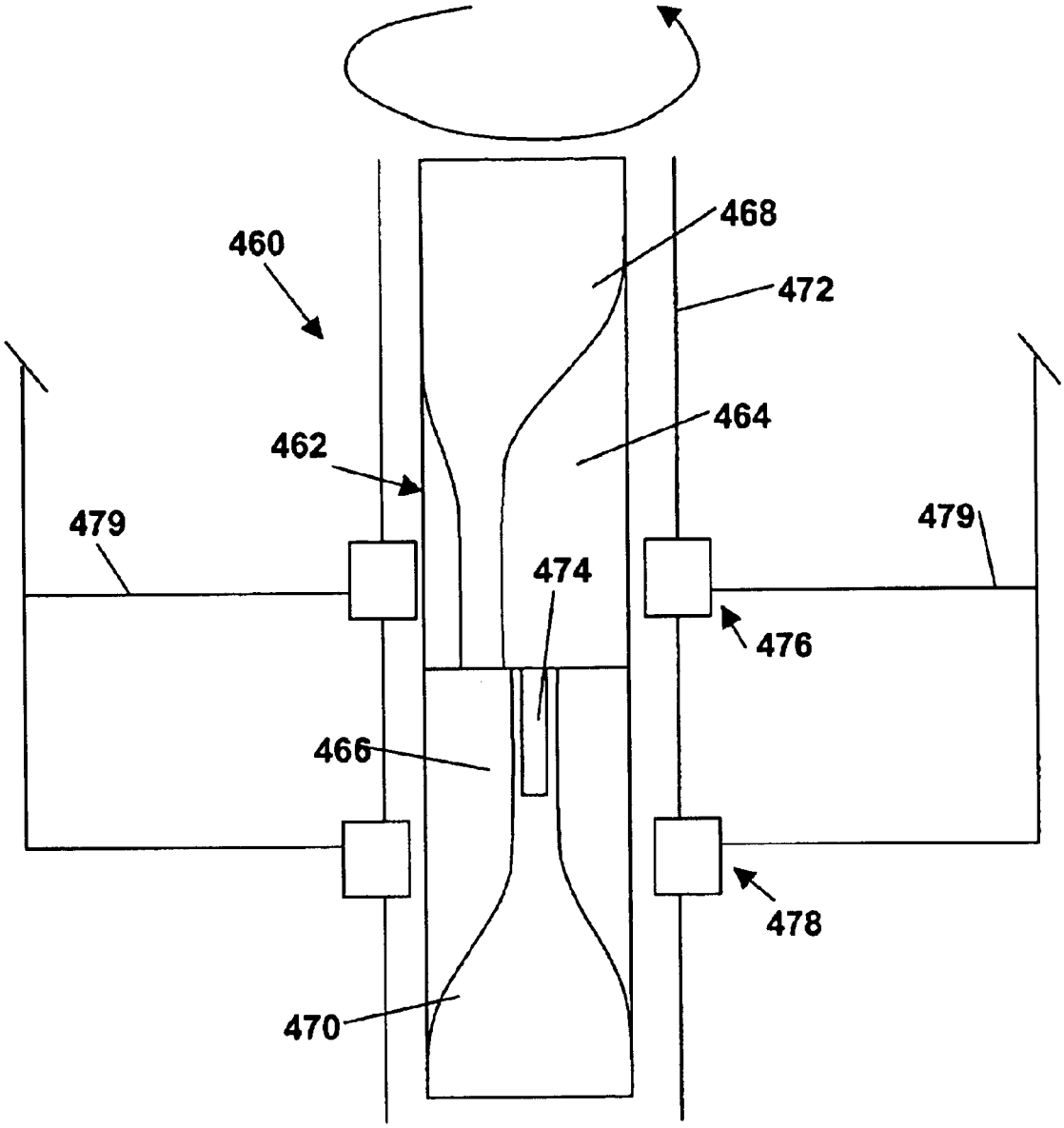
FIG. 4F schematically illustrates a housing having rotatable sections and an exemplary trigger for rotating the sections.

Referring now to FIG. 4F there is shown still another embodiment of a safety apparatus 460 made in accordance with the teachings of the present invention. The safety apparatus 460 includes a bypass (not shown), a housing 462 having an upper section 464 and a lower section 466. Each section 464,466 is provided with an alignment channel 468,470, respectively. Further, the sections 464,466 are joined such that the sections 464,466 can rotate relative to one another a sufficient amount to bring the channels 468, 470 into an out of alignment. This relative angular alignment and misalignment causes the bypass (not shown) to move between the safe and fire ready modes. Positioned on a stationary surface 472 are an alignment pin 474, a first hydraulic ram 476, a second hydraulic ram 478, a hydraulic fluid line 479, and a hydraulic source (not shown). The rams 476,478 are configured to engage the upper and lower sections 464,466, respectively. Additionally, one or both of the rams 476,478 are further adapted to rotate one or both of the sections 464,466 a predetermined amount. Merely for clarity, the alignment pin 474 is shown within the lower section alignment channel 470 and not fixed to the stationary surface 472. Before deployment, the housing 462 is in a first position wherein the channels 468,470 are misaligned. Thus, during downward travel of the housing 462, the alignment pin 474 will ride along the lower section alignment channel 470 until it strikes the upper section 464 (as shown). Thereafter, the rams 476,478 engage the housing 462 and rotate one or both of the sections 464,466 until the alignment channels 468,470 are aligned. Upon alignment, the bypass has moved, for example, from a safe mode to a fire ready mode, and the housing 462 can continue its downward motion.

Figure 4G:
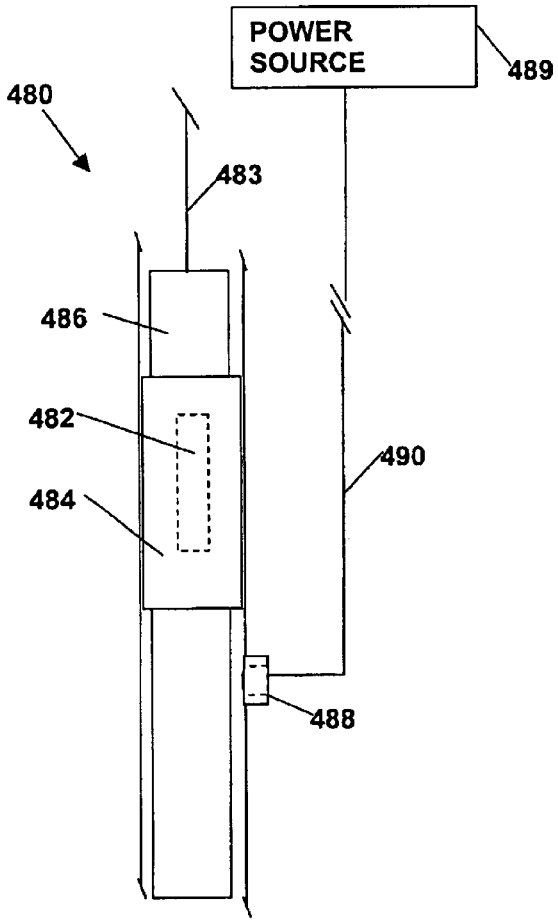
FIG. 4G schematically illustrates a housing having a sliding sleeve and a stationary hydraulically actuated trigger in a retracted position.
Figure 4H:
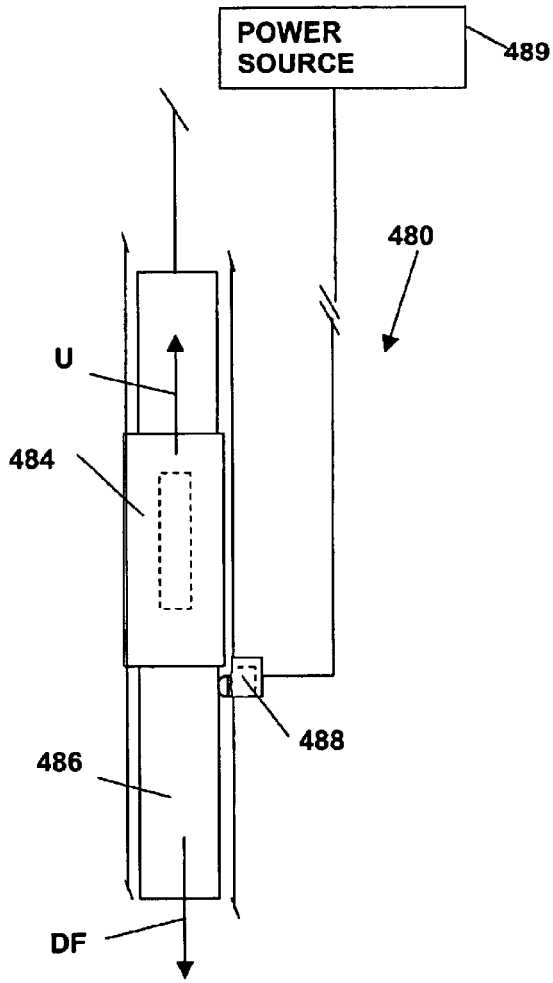
FIG. 4H schematically illustrates a housing having a sliding sleeve and a stationary hydraulically actuated trigger in a extended position.

Referring now to FIGS. 4G and 4H there is shown yet another embodiment of a safety apparatus 480 made in accordance with the teachings of the present invention. The safety apparatus 480 includes a bypass 482, a sleeve 484, a housing 486, and a trigger 488. As previously described, the bypass 482 selectively allows an initiation signal transmitted via a signal conveyance medium 483 to reach the initiation device (not shown) of a downhole tool (not shown). The sleeve 484 is mechanically coupled to the bypass 482 in a known fashion and slides between a first position and a second position, the positions corresponding to a safe and fired ready mode of the bypass 482, respectively. While the sleeve 484 is preferably a ring-like member, other shapes such as bars that partially or completely surround the housing 486 may also be adequate. Moreover, the sleeve 484 need not move strictly in a liner fashion but may rotate, pivot, or move in some other prescribed manner upon engaging the trigger 488. The trigger 488 is a hydraulically actuated member that moves from a nominal retracted position (FIG. 4G) to an extended position (FIG. 4H) when energized by hydraulic fluid provided by a power source 489 via a fluid line 490. In the retracted position, the trigger 488 allows the sleeve 484 to pass freely down the well bore. In an extended position, the trigger 488 provides a rigid shoulder against which the sleeve 484 abuts. During deployment, the trigger 488 is in an extended position, thereby blocking the downward motion of the sleeve 484, which is in the first position. Once personnel determine that downward motion has stopped, a downhole force DF is applied to the housing 486. This force DF may be applied by the weight of the downhole tool or other components or by surface equipment (e.g., a tubing injector)(not shown) applying a force to the housing 486. The force DF thus causes, in effect, the sleeve 484 in move in an upward direction U from the first position to the second position, thereby placing the bypass 482 in a fire ready mode. Thereafter, the trigger is moved to a retracted position by using the power source 488. Some time after the sleeve 484 has cleared the trigger 456, the trigger 456 can be returned to an extended position. It should be apparent that the above steps are generally repeated to move the sleeve 484 from the second position to the first position to place the bypass 482 in a safe mode.

Figure 5:
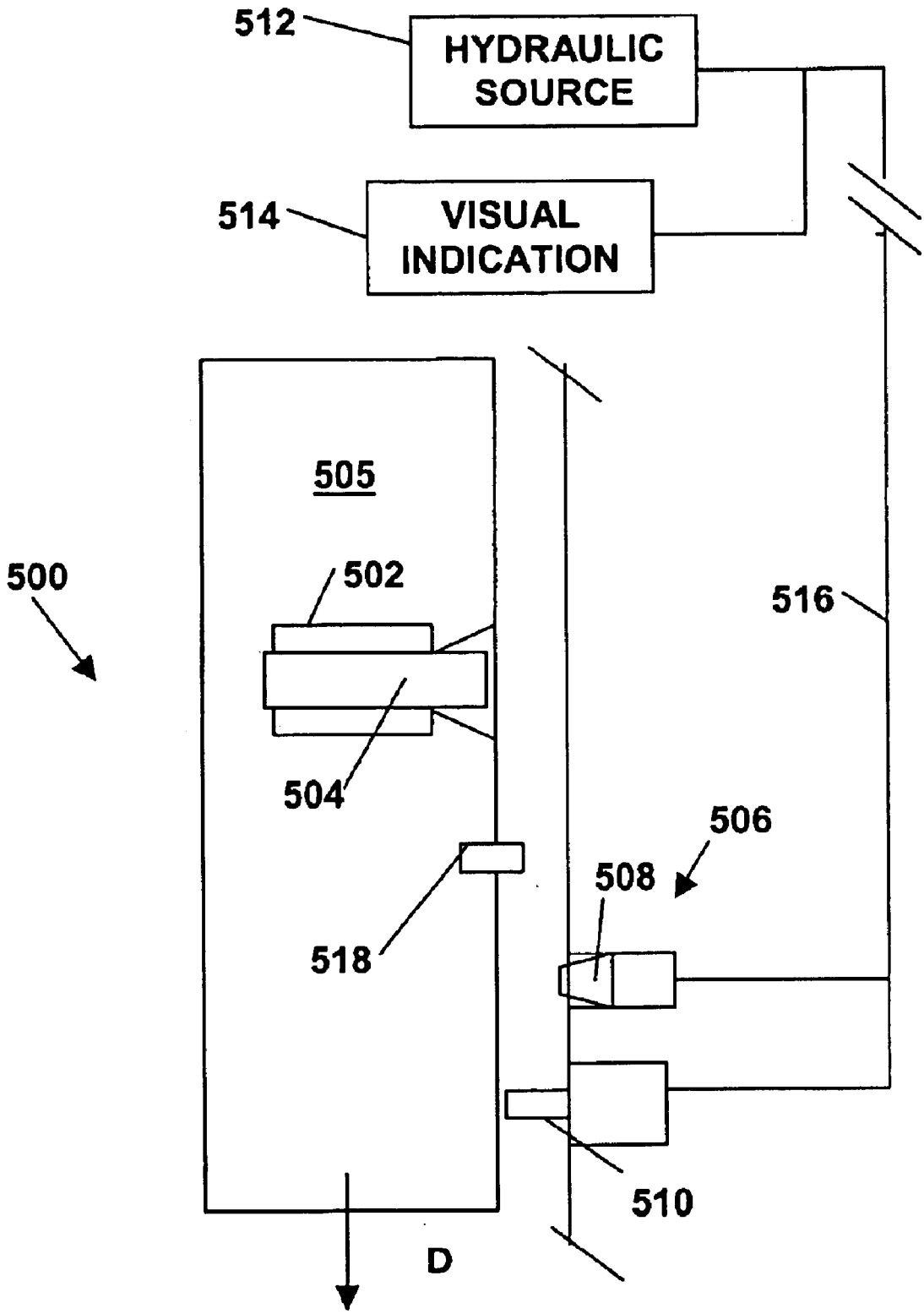
FIG. 5 schematically illustrates an exemplary embodiment of a safety system using a hydraulically actuated alignment pin to align a switch with a trigger.

Referring now to FIG. 5, there is shown an exemplary safety arrangement 500 that utilizes hydraulically actuated components. Safety arrangement 500 includes a bypass 502, a switch 504, and a trigger assembly 506. The bypass 502 and switch 504 are disposed in a housing or sub 505 and are similar to those already described. Therefore, discussions of similar features will not be repeated. The trigger assembly 506 includes a hydraulically actuated finger 508 and a hydraulically actuated alignment pin 510, which are axially spaced apart a predetermined distance. Located at the surface are a hydraulic source 512 and a mode indicator 514. The hydraulic source 512 provides pressurized hydraulic fluid to the trigger assembly 506 via a hydraulic line 516. The housing includes a lip 518 that is axially spaced from the switch 504 at generally the same distance that separates the finger 508 and the alignment pin 510. During deployment, the finger 508 is in a retracted state whereas the alignment pin 510 is in an extended state. Known biasing members (not shown) may be used to retain the finger 508 and the pin 510 in these nominal states. As the housing 505 moves in direction D, the lip 518 will eventually abut and rest on the extended pin 510. At this point, the finger 508 will be aligned with the switch 504. With these components so aligned, the hydraulic source 512 is operated to pressurize the finger 508. The applied hydraulic force urges the finger 508 against and actuates the switch 504. This source 512 can either simultaneous or in a delayed fashion (e.g., by inserting restriction valves (not shown)) provide hydraulic fluid to the alignment pin 510. The applied hydraulic fluid urges the pin 510 into a retracted state and thereby allows the lip 518 to pass unobstructed. The visual indicator 514 can be configured to provide an indication that the finger 508 has been fully extended and, therefore, the bypass 502 has been placed in a fire ready mode. After the housing 505 is moved in direction D downhole, the hyuraulic source 512 can be actuated to return the finger 508 and pin 510 to their nominal states (retracted and extended, respectively).

It will be appreciated that the FIG. 5 embodiment is also amenable to numerous modifications and adaptations. For example, in a manner analogous to FIG. 4C, two trigger assemblies (not shown) may be used to actuate the bypass. Alternatively, the finger and switch may be adapted to engage in a locking fashion such that actuation of the finger will move the switch from a first position to a second position, and a second position to a first position. In still another arrangement, the switch may be modified to move between two or more positions upon being actuated (e.g., in a ratchet type fashion). Of course, the finger and switches are not limited to linear movement. Still other modifications and adaptations will be apparent to one of ordinary skill in the art.

Figure 6A:
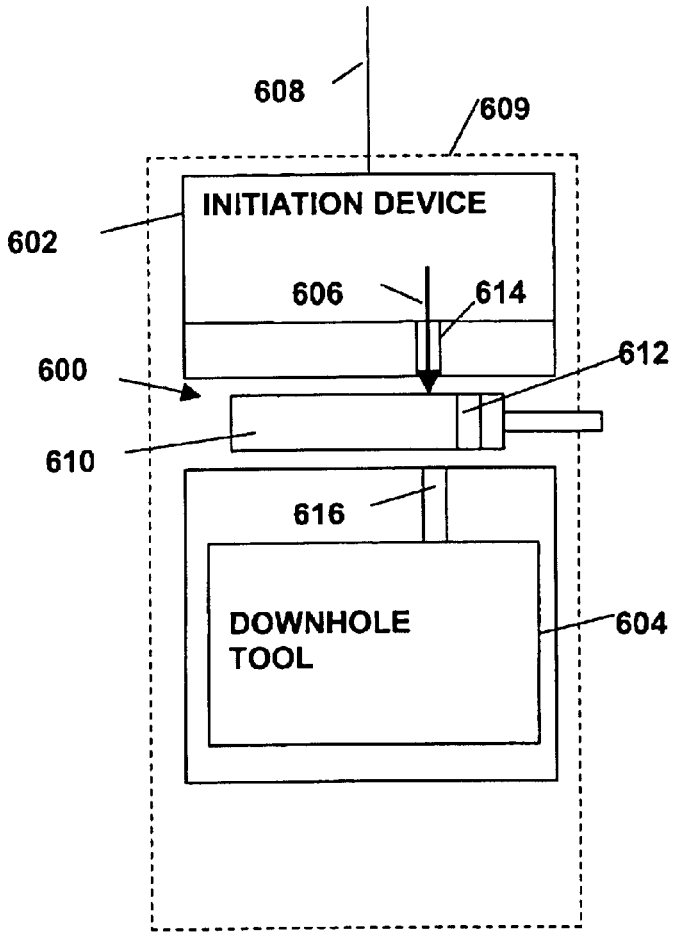
FIG. 6A schematically illustrates a safe mode of an exemplary bypass that is adapted to selectively permit transmission of an energy stream to a downhole tool.
Figure 6B:
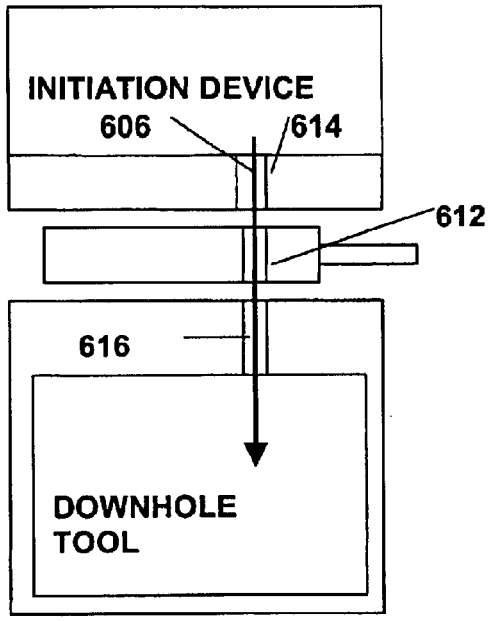
FIG. 6B schematically illustrates a fire ready mode of an exemplary bypass that is adapted to selectively permit transmission of an energy stream to a downhole tool.

Referring now to FIGS. 6A and 6B, there is shown another embodiment of the present invention for preventing an unintended or premature surface activation or detonation of a downhole tool that uses an energy train or stream as the method to initiate activation, one or more explosive charges. A preferred energy safety apparatus 600 is used in conjunction with an initiation device 602 adapted to activate a downhole tool 604 with an energy train 606. The initiation device 602 can be operated by a surface controller (not shown) via a telemetry line 608 or a local controller (not shown). The several components may be in a single housing or separate housing referred to with numeral 609. The energy safety apparatus 600 includes a bypass 610 provided with a passage 612. The passage 612 is formed to allow the transfer the energy train 606 traveling from a first conduit 614 associated with the initiation device 602 to a second conduit 616 associated with the downhole tool 604. The bypass 610 is adapted to provide a selective alignment/misalignment between the passage 612 and the conduits 614,616. For example, the bypass 610 can be a bar or plate that is adapted to slide axially in a direction transverse to the downhole tool axis. Alternatively, the bypass 610 can be a disk that rotates. Thus, the bypass 610 has a safe mode wherein misalignment between the passage 612 and the conduits 614,616 prevents the energy train 606 from reaching the downhole tool 604; and a fire ready mode wherein the passage 612 and the conduits 614,616 are aligned (FIG. 6B) to provide a path for the energy train 606. In some instances, a partially blockage between conduit 614 and conduit 616 may be sufficient to prevent activation of the downhole tool (not shown). It should be understood that any of the above-described switches and triggers may be used with the energy safety apparatus 600 to actuate the bypass 610. Accordingly, for brevity, their description will not be repeated.

Figure 7:
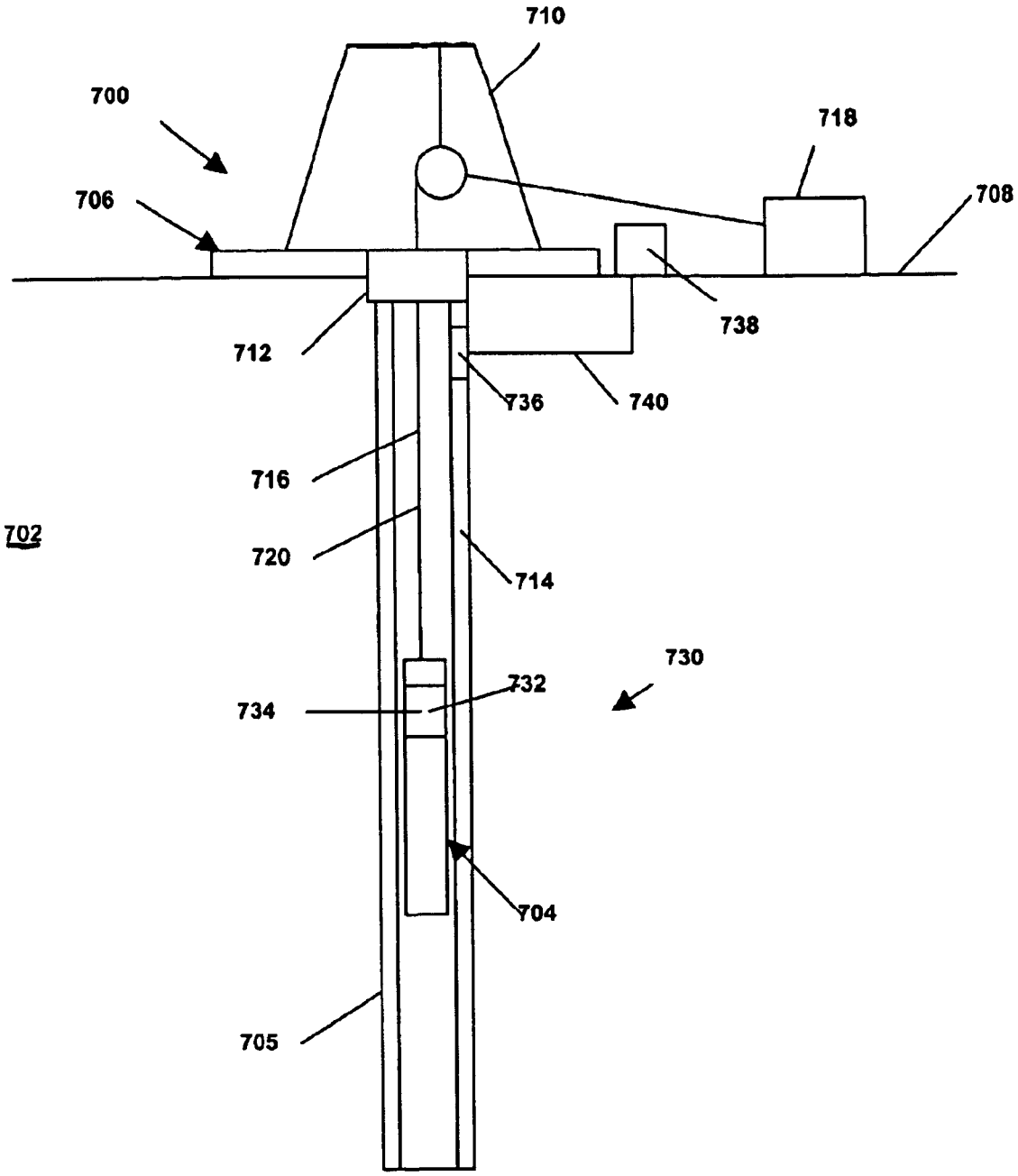
FIG. 7 schematically illustrates an elevation view of a surface facility adapted to perform one or more pre-defined tasks in a wellbore using one or more downhole tools.

Referring now to FIG. 7, there is shown a well construction and/or hydrocarbon production facility 700 positioned over a subterranean formation of interest 702. A preferred embodiment of a safety apparatus made in accordance with the present invention can be advantageous used to deploy a downhole tool 704 adapted to perform one or more predetermined downhole tasks in a well bore 705. The facility 700 can include known equipment and structures such as a platform 706 at the earth's surface 708, a derrick 710, a wellhead 712, and cased or uncased pipe/tubing 714. A work string 716 is suspended within the well bore 705 from the derrick 710. The work string 716 can include drill pipe, coiled tubing, wire line, slick line, or any other known conveyance means. The work string 716 can include telemetry lines or other signal/power transmission mediums that establish one-way or two-way telemetric communication from the surface to the downhole tool 704 connected to an end of the work string 716. A suitable telemetry system (not shown) can be known types as mud pulse, electrical signals, acoustic, or other suitable systems. For brevity, a telemetry system having a surface controller (e.g., a power source) 718 adapted to transmit electrical signals via a cable or signal transmission line 720 disposed in the work string 716 is shown.

A preferred safety device 730 for use with the downhole tool 704 includes a bypass 732 and switch 734 provided on the downhole tool 704 and a trigger 736 fixed on a stationary location at the wellhead 712, in the casing/piping 714, or other suitable sub-surface location. The trigger 736 can be hydraulically coupled to a hydraulic source 738 via a hydraulic line 740.

For clarity, the use of the safety device 730 will be discussed with reference to perforating guns. It should appreciated, however, that the safety device 730 is, by any means, limited to such use.

Preferably, the safety device 730 is incorporated into the design of the downhole tool. Thus, upon assembly at a factory, for example, the safety device 730 positively maintains the downhole tool in a safe mode without any further human or other intervention. Referring still to FIG. 7, upon arrival at the facility 700, the downhole tool 704 is fixed onto the work string 716 and inserted into the wellhead 712 via known equipment (not shown). As the downhole tool 704 is lowered into the wellbore 705, the tool 704 will eventually encounter the stationary trigger 736. In one arrangement, the mere axial travel of the tool 704 will passively shift the bypass 732 from a safe mode to a fire ready mode. In another arrangement, the downward motion of the tool 704 is momentarily interrupted while the bypass 732 is actively shifted from a safe mode to a fire ready mode. Thereafter, the surface controller 718 or a local controller (not shown) on the downhole tool 704 can activate the downhole tool 704 once the desired parameters are met.

During extraction, the downhole tool 704 is trigger 736, either actively or passively, shifts the bypass from a fire ready mode to a safe mode. Thus, the downhole tool 704 can be safely removed from the wellbore 705 with minimal risk of unintended activation.

In the preferred embodiments of the present invention, the safety devices use components that do not generate or radiate signals, energy, or other energy waves that could inadvertently provide an initiation signal. Additionally, as noted earlier, the components of the preferred system may be positioned at any suitable location in a work string or downhole tool. In a preferred arrangement, the bypass and/or trigger is integrated within the downhole tool, an associated housing/sub or other related enclosure. This arrangement will reduce or eliminate some of the assembly work at the platform prior to tool deployment.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention. It is intended that the following claims be interpreted to embrace all such modifications and changes.

What is claimed is:

1. An apparatus for controlling an initiation device for a downhole tool to be deployed in a well bore, the initiation device activating the downhole tool upon receiving an initiation signal via a signal conveyance medium, the apparatus comprising:

(a) a bypass connected to the signal conveyance medium, said bypass having a first mode wherein said bypass prevents the initiation signal to pass to the initiation device and a second position wherein said bypass allows the initiation signal to pass to the initiation device;

(b) a switch operably coupled to said bypass, said switch being adapted to move said bypass at least from said first mode to said second mode when actuated; and (c) a trigger fixed at a first location that is relatively stationary with respect to the well bore, said trigger being adapted to actuate said switch.

2. The apparatus of claim 1 further comprising a mode indicator operably connected to said trigger, said mode indicator providing an indication of whether said bypass can pass the initiation signal to the initiation device.

3. The apparatus of claim 1 wherein said bypass is configured to allow the passing of one of electrical power and data signals to the downhole tool.

4. The apparatus of claim 1 wherein said switch is further adapted to move said bypass from said second position to said first position when actuated.

5. An apparatus for controlling an initiation device for a downhole tool to be deployed in a well bore, the initiation device activating the downhole tool upon receiving an initiation signal via a signal conveyance medium, the apparatus comprising:

(a) a bypass connected to the signal conveyance medium, said bypass having a first mode wherein said bypass prevents the initiation signal to pass to the initiation device and a second position wherein said bypass allows the initiation signal to pass to the initiation device;

(b) a switch operably coupled to said bypass, said switch being adapted to move said bypass at least from said first mode to said second mode when actuated; and (c) a trigger positioned at a first location that is relatively stationary with respect to the well bore, said trigger being adapted to actuate said switch wherein said trigger includes a hydraulically actuated finger.

6. An apparatus for controlling an initiation device for a downhole tool to be deployed in a well bore, the initiation device activating the downhole tool upon receiving an initiation signal via a signal conveyance medium, the apparatus comprising:

(a) a bypass connected to the signal conveyance medium, said bypass having a first mode wherein said bypass prevents the initiation signal to pass to the initiation device and a second position wherein said bypass allows the initiation signal to pass to the initiation device:

(b) a switch operably coupled to said bypass, said switch being adapted to move said bypass at least from said first mode to said second mode when actuated; and (c) a trigger positioned at a first location that is relatively stationary with respect to the well bore, said trigger being adapted to actuate said switch, wherein said switch is further adapted to move said bypass from said second position to said first position when actuated, and further comprising a second trigger positioned at a second location that is relatively stationary with respect to the well bore, said second trigger being adapted to actuate said switch to move said bypass from said second mode to said first mode.

7. A system for performing a pre-defined task in a wellbore, comprising:

(a) a downhole tool adapted to perform the pre-defined task;

(b) a surface facility adapted to convey said downhole tool into a wellbore, said surface facility being positioned at the earth's surface;

(c) a work string suspended from said surface facility, said downhole tool being connected to said work string, said work string including a signal conveyance medium;

(d) a source operably connected to said signal conveyance medium, said source configured to selectively generate an initiation signal;

(e) an initiation device coupled to said signal conveyance medium and adapted to receive said initiation signal, said initiation device activating said downhole tool upon receiving said initiation signal;

(f) a bypass operably coupled to said signal conveyance medium, said bypass adapted to selectively allow said initiation signal to pass to said initiation device;

(g) a switch for operating said bypass, said switch having a first position wherein said switch and said bypass cooperate to prevent said initiation signal to pass to said initiation device and a second position wherein said switch and said bypass cooperate to allow said initiation signal to pass to said initiation device; and (h) a trigger fixed at a first location that is relatively stationary with respect to the earth's surface, said trigger being adapted to move said switch from said first position to said second position.

8. The system of claim 7 wherein said downhole tool comprises at least one perforating gun.

9. The system of claim 7 wherein said initiation signal comprises electrical energy.

10. A system for performing a pre-defined task in a wellbore, comprising:

(a) a downhole tool adapted to perform the pre-defined task;

(b) a surface facility adapted to convey said downhole tool into a wellbore, said surface facility being positioned at the earth's surface;

(c) a work string suspended from said surface facility, said downhole tool being connected to said work string, said work string including a signal conveyance (d) a source operably connected to said signal conveyance medium, said source configured to selectively generate an initiation signal;

(e) an initiation device coupled to said signal conveyance medium and adapted to receive said initiation signal, said initiation device activating said downhole tool upon receiving said initiation signal;

(f) a bypass operably coupled to said signal conveyance medium, said bypass adapted to selectively allow said initiation signal to pass to said initiation device (g) a switch for operating said bypass, said switch having a first position wherein said switch and said bypass cooperate to prevent said initiation signal to pass to said initiation device and a second position wherein said switch and said bypass cooperate to allow said initiation signal to pass to said initiation device; and (h) a trigger positioned at a first location that is relatively stationary with respect to the earth's surface, said trigger being adapted to move said switch from said first position to said second position, further comprising a housing enclosing said bypass and said switch, said housing including an alignment channel for guiding said trigger to said switch.

11. An apparatus for controlling an initiation device for a downhole tool, the initiation device activating the downhole tool upon receiving an initiation signal via a signal conveyance medium, comprising:

(a) a first device operably connected to the signal conveyance medium, said first device configured to permit signal pass-through upon reaching a pre-determined depth below the earth's surface; and (b) a second device fixed at the predetermined depth below the earth's surface, said second device adapted to positively engage said first device to provide a positive indication that the predetermined depth has been reached.

12. The apparatus of claim 11 further comprising:

(a) a housing for enclosing said bypass; and (b) wherein said first device comprises:

(i) a bypass operably connected to the signal conveyance medium, said bypass being configured to allow selective signal pass-through; and (ii) a sleeve associated with said bypass, said sleeve being slidably mounted on said housing, said sleeve adapted to slide between a first position wherein said bypass permits signal pass-through and a second position wherein said bypass prevents signal pass-through; and (c) wherein said second device comprises a trigger member having an extended position wherein said sleeve is prevented from moving in a pre-defined direction, whereby a predetermined force applied to said housing causes relative sliding motion between said sleeve and said housing, said sliding motion moving said sleeve from one of said first position to said second position and said second position to said first position.

13. An apparatus for controlling an initiation device for a downhole tool, the initiation device activating the downhole tool upon receiving an initiation signal via a signal conveyance medium, comprising:

(a) a first device operably connected to the signal conveyance medium, said first device configured to permit signal pass-through upon reaching a pre-determined death below the earth's surface; and (b) a second device positioned at the predetermined depth below the earth's surface, said second device adapted to positively engage said first device to provide a positive indication that the predetermined depth has been reached, wherein said first device includes a first section rotatably coupled to a second section; said first device preventing signal pass-through when said first and second sections have a first relative angular alignment and permitting signal pass-through when said first and second sections have a second relative angular alignment; and wherein said second device is configured to move said first and second sections between said first and second relative angular alignments.

14. The apparatus of claim 13 wherein said first and second sections each include a channel for receiving an alignment pin associated with said second device, said channels aligning to allow passage of said pin when said sections are in said first relative angular alignment and not aligning to prevent passage of said pin when said sections are in said second relative angular alignment.

15. The apparatus of claim 13 wherein said second device includes hydraulically actuated rams for rotating said sections from said first relative angular alignment to said second relative angular alignment.

16. An apparatus for controlling an initiation device for a downhole tool, the initiation device activating the downhole tool by generating an energy train that is transmitted via an energy conveyance conduit, comprising:

(a) a first device operably connected to the energy conveyance conduit, said first device configured to permit selective energy train pass-through upon reaching a pre-determined depth below the earth's surface; and (b) a second device fixed at the predetermined depth below the earth's surface, said second device adapted to positively engage said first device to provide a positive indication that the predetermined depth has been reached.

17. An apparatus for controlling an initiation device for a downhole tool, the initiation device activating the downhole tool by generating an energy train that is transmitted via an energy conveyance conduit, comprising:

(a) a first device operably connected to the energy conveyance conduit, said first device configured to permit selective energy train pass-through upon reaching a pre-determined depth below the earth's surface; and (b) a second device positioned at the predetermined depth below the earth's surface, said second device adapted to positively engage said first device to provide a positive indication that the predetermined depth has been reached wherein said first device includes a first section rotatably coupled to a second section; said first device preventing energy train pass-through when said first and second sections have a first relative angular alignment and permitting energy train pass-through when said first and second sections have a second relative angular alignment; and wherein said second device is configured to move said first and second sections between said first and second relative angular alignments.

18. A method for controlling an initiation device for a downhole tool, the initiation device activating the downhole tool upon receiving an initiation signal via a signal conveyance medium, the method comprising:

(a) establishing a relatively stationary location at a predetermined depth below the earth's surface below which the initiation device is allowed to activate the downhole tool;

(b) fixing a trigger device at the relatively stationary location to engage the initiation device;

(c) preventing the initiation signal to pass to the initiation device while the initiation device is above the relatively stationary location;

(d) moving the initiation device through the relatively stationary location such that the initiation device engages the trigger device and (e) allowing the initiation signal to pass to the initiation device after the initiation device is below the relatively stationary location.

19. The method of claim 18 further comprising providing a surface indication of whether the initiation signal can pass to the initiation device.

20. The method of claim 18 further comprising providing a bypass configured to selectively pass the initiation signal to the initiation device.

21. The method of claim 18 further comprising positioning a trigger at the relatively stationary location; and actuating the bypass with the trigger to allow the initiation signal to pass to the initiation device.

22. A method for controlling an initiation device for a downhole tool, the initiation device activating the downhole tool by generating an energy train that is transmitted via an energy conveyance conduit, the method comprising:

(a) establishing a relatively stationary location at a predetermined depth below the earth's surface below which the initiation device is allowed to activate the downhole tool;

(b) fixing a tripper device at the relatively stationary location;

(c) preventing the transmission of the energy train to the downhole tool while the initiation device is above the relatively stationary location;

(d) engaging the trigger device with the initiation device as the initiation device passes through the relatively stationary location; and (e) allowing the transmission of the energy train to the downhole tool after the initiation device is below the relatively stationary location.

23. The method of claim 22, further comprising connecting a first device to the energy conveyance conduit; configuring the first device to selectively transmit the energy train to the downhole tool; and configuring the trigger device to positively engage the first device to permit energy train transmission to the downhole tool.

* * * * *